US009305527B2

(12) United States Patent
Dwylitis

(10) Patent No.: US 9,305,527 B2
(45) Date of Patent: Apr. 5, 2016

(54) ACOUSTIC INSTRUMENT WITH NECK THROUGH BODY

(71) Applicant: UNCLE DAVE'S CUSTOM GUITARS, INC., Troy, MI (US)

(72) Inventor: David Dwylitis, Troy, MI (US)

(73) Assignee: Uncle Dave's Custom Guitars, LLC, Troy, MI (US)

( * ) Notice: Subject to any disclaimer, the term of this patent is extended or adjusted under 35 U.S.C. 154(b) by 0 days.

(21) Appl. No.: 14/833,647

(22) Filed: Aug. 24, 2015

(65) Prior Publication Data

US 2016/0055835 A1 Feb. 25, 2016

Related U.S. Application Data

(60) Provisional application No. 62/040,919, filed on Aug. 22, 2014.

(51) Int. Cl.
*G10D 3/06* (2006.01)

(52) U.S. Cl.
CPC ..... *G10D 3/06* (2013.01)

(58) Field of Classification Search
CPC ..... G10D 1/08; G10D 1/085; G10D 1/005; G10D 1/00; B27C 9/04; B27D 1/08; B27F 1/08; B27H 1/00; B27M 3/00
USPC ..... 84/267, 290, 293
See application file for complete search history.

(56) References Cited

U.S. PATENT DOCUMENTS 6,833,501 B2 * 12/2004 Jagmin ..... G10D 3/06 84/267
2014/0144306 A1 * 5/2014 Seal ..... G10D 1/005 84/291

* cited by examiner

*Primary Examiner* — Kimberly Lockett
(74) *Attorney, Agent, or Firm* — Avery N. Goldstein; Blue Filament Law

(57) ABSTRACT

An acoustic string instrument is provided that includes a headstock formed at a distal end of a neck. The headstock and the neck are formed with a plurality of laminated material strips. A heel is formed at the proximal end of the neck. The heel is fixedly attached to a hollow body having a bottom surface joined to a top surface by a sidewall defining an inner volume. A pair of opposing outer strips from the plurality of laminated material extend past the heel to form an "A" brace in the inner volume, where the "A" brace has a plurality of apertures and an integrated bridge post that extends between the bottom surface and an inner side of the top surface of the hollow body. One or more transverse braces are fixedly attached to the inner side of the top surface, where each of the one or more transverse braces crosses through the plurality of apertures of the "A" brace without touching the "A" brace.

3 Claims, 9 Drawing Sheets

ACOUSTIC INSTRUMENT WITH NECK THROUGH BODY

RELATED APPLICATIONS

This application claims priority benefit of U.S. Provisional application Ser. No. 62/040,919 filed Aug. 22, 2014; the contents of which are hereby incorporated by reference.

FIELD OF THE INVENTION

The present invention relates to the field of instruments and more particularly relates to acoustic string instruments with a neck through body design with reduced bracing for enhanced total sound quality.

BACKGROUND OF THE INVENTION

A string instrument typically makes sound by the playing of the instrument's strings with the sound being projected either acoustically or through electrical amplification (for an acoustic instrument or an electric instrument, respectively). The most common string instrument is the guitar with six strings, which is typically played by strumming or plucking the strings with the right hand while fretting the strings with the left hand. The guitar is a type of chordophone, traditionally constructed from wood and strung with either nylon or steel strings and distinguished from other chordophones by its construction and tuning.

The construction of the body is what characterizes the guitar. Certain kinds of guitars are called "solid body guitars" or "hollow body guitars", and the type of construction influences the tone, and how the tone is produced. Solid body guitars, such as an electric guitar which is not just "electric", uses the whole guitar body for vibration so there are several parts that form the tone, not just the strings and the pickups as in a hollow body guitar. A solid body is made out of logs of solid wood that are glued together, or out of laminated wood, or plywood. Plywood guitars are cheaper, but they don't sound as good. Solid body guitars don't feedback that easily.

Hollow body guitars as the name implies have a hollow body that is made out of several parts, like a top, a back, and sides, etc. The neck of the hollow body guitar terminates at the heel and does not enter the guitar body. The sound of a hollow body is usually warmer (or more "natural" than that of a solid body. A disadvantage of hollow bodies is that they feedback more easily if the hollow body is too close to the amplifier.

An acoustic guitar is a guitar that uses only acoustic (as opposed to electronic) means to transmit the strings' vibrational energy to the air in order to produce a sound, and typically involves the use of a sound board (top) and a sound box (hollow body) to amplify the vibrations of the string. The source of sound in an acoustic guitar is the string, which is plucked with the fingers or with a plectrum. The string vibrates at a fundamental frequency but also creates many harmonics at different frequencies. The frequencies produced depend on string length, mass, and tension. The string causes the soundboard and sound box to vibrate, and as these have their own resonances at certain frequencies, the soundboard and sound box amplify some string harmonics more strongly than others, hence affecting the timbre produced by the instrument.

The acoustic guitar's soundboard, or top, also has a strong effect on the loudness of the guitar. No amplification actually occurs in this process, because no external energy is added to increase the loudness of the sound (as would be the case with an electronic amplifier). All the energy is provided by the plucking of the string. But without a soundboard, the string would just "cut" through the air without actually moving it much. The soundboard increases the surface of the vibrating area in a process called mechanical impedance matching. The soundboard can move the air much more easily than the string alone, because it is large and flat. This increases the entire system's energy transfer efficiency, and a much louder sound is emitted.

In addition, the acoustic guitar has a hollow body and an additional coupling and resonance effect increases the efficiency of energy transmission in lower frequencies. The air in a guitar's cavity resonates with the vibrational modes of the string and soundboard. At low frequencies, which depend on the size of the box, the chamber acts like a Helmholtz resonator, increasing or decreasing the volume of the sound again depending on whether the air in the box is moving in phase or out of phase with the strings. When in phase, the sound is increased by about 3 decibels and when in opposing phase, it is decreased about 3 decibels. As a Helmholtz resonator, the air at the opening is vibrating in or out of phase with the air in the box and in or out of phase with the strings. These resonance interactions attenuate or amplify the sound at different frequencies, boosting or damping various harmonic tones. Ultimately, the cavity air vibrations couple to the outside air through the sound hole, or have f holes, like a violin family instrument. This coupling is most efficient because here the impedance matching is perfect: it is air pushing air.

FIG. 1 and FIG. 2 illustrate a typical prior art acoustic guitar 10. The guitar 10 has a headstock 12 that is located at the end of the guitar neck 14 farthest from the body 40. The headstock 12 is fitted with machine heads tuners 16 that adjust the tension of the strings 30, which in turn affects the pitch. The nut 18 is a small strip of bone, plastic, brass, corian, graphite, stainless steel, or other medium-hard material, at the joint where the headstock 12 meets the fretboard 22. The nut 18 has grooves that guide the strings 18 onto the fretboard 22, giving consistent lateral string placement, and is one of the endpoints of the strings' vibrating length. The fretboard 22 is a piece of wood embedded with metal frets 20 that encompasses the top of the neck 14. Pinching a string against the fretboard 22 effectively shortens the vibrating length of the string, producing a higher pitch. A guitar's fretboard 22, tuners 16, and headstock 12 all attached to a long wooden extension, and collectively constitute the guitars neck 14. The wood used to make the fretboard 22 usually differs from the wood in the rest of the neck 14. The bending stress on the neck 14 is considerable, particularly when heavier gauge strings are used, and the ability of the neck 14 to resist bending is important to the guitar's ability to hold a constant pitch during tuning or when strings are fretted. The rigidity of the neck 7 with respect to the body of the guitar 10 is one determinant of a good instrument versus a poor one. The heel 24 is the point at which the neck 14 is either bolted or glued to the body 40 of the guitar 10.

The truss rod is a metal rod that runs along the inside of the neck 14. The truss rod is used to correct changes to the neck's curvature caused by the neck timbers aging, changes in humidity or to compensate for changes in the tension of strings. The tension of the rod and neck assembly is adjusted by a hex nut or an allen-key bolt on the rod, usually located either at the headstock 12, sometimes under a cover, or just inside the body of the guitar underneath the fretboard 22 and accessible through the sound hole 28. Some truss rods can only be accessed by removing the neck 14. The truss rod counteracts the immense amount of tension the strings 30 place on the neck 14, bringing the neck 14 back to a straighter position.

The lack of extension of the neck 14 into the body 40 (see FIG. 2) is a feature that distinguishes a hollow body acoustic guitar or acoustic instrument from a solid body guitar or instrument. Solid body instruments have a neck-through-body construction that extends the piece (or pieces, in a laminate construction) of wood used for the neck through the entire length of the body, essentially making the neck a core of the body, resulting in improved stability. The strings, fretboard, pickups and bridge are all mounted on this piece. In the typical solid body, "ears" or "wings" (i.e., side parts of the body) are glued or laminated to the central "stick". Neck-thru construction allows easier access to upper frets, because there is no need for a heel 24—the thickened area where a neck would attach to the body. Many musicians assert that neck-through construction provides greater sustain of sound and allows the instrument to stay in tune longer.

The body 40 of the guitar 10 has a cavity contained by the bottom 26, body side wall (rib) 32, and top or soundboard 36. The soundboard 36 has the sound hole 28 positioned under the strings 30. The strings 28 terminate at the bridge 38, which transfers the vibration from the strings 30 to the soundboard 36, which vibrates the air inside of the guitar, thereby amplifying the sound produced by the strings. The saddle 34 is the part of the bridge 38 that physically supports the strings 30. The saddle 34 provides the end point for the string's vibration at the correct location for proper intonation.

FIG. 2 is a prior art sectional view with a portion of the side wall 32 and top 36 of the acoustic guitar 10 removed showing the hollow cavity 42. As can be seen the neck terminates at the heel 24, and does not extend in the body 40 to the tail block 44. A series of braces 46 provide structural support to the body 40.

While acoustic instrument designs have evolved over time, the hollow body design lacks the advantages of solid body instruments. Thus, there exists a need for a hollow body design that incorporates a neck through body design with reduced bracing for enhanced total sound quality.

SUMMARY OF THE INVENTION

An acoustic string instrument is provided that includes a headstock formed at a distal end of a neck. The headstock and the neck are formed with a plurality of laminated material strips. A heel is formed at the proximal end of the neck. The heel is fixedly attached to a hollow body having a bottom surface joined to a top surface by a sidewall defining an inner volume. A pair of opposing outer strips from the plurality of laminated material extend past the heel to form an "A" brace in the inner volume, where the "A" brace has a plurality of apertures and an integrated bridge post that extends between the bottom surface and an inner side of the top surface of the hollow body. One or more transverse braces are fixedly attached to the inner side of the top surface, where each of the one or more transverse braces crosses through the plurality of apertures of the "A" brace without touching the "A" brace.

BRIEF DESCRIPTION OF THE DRAWINGS

The subject matter that is regarded as the invention is particularly pointed out and distinctly claimed in the claims at the conclusion of the specification. The foregoing and other objects, features, and advantages of the invention are apparent from the following detailed description taken in conjunction with the accompanying drawings in which:

DETAILED DESCRIPTION OF THE PREFERRED EMBODIMENTS

Figure 1:
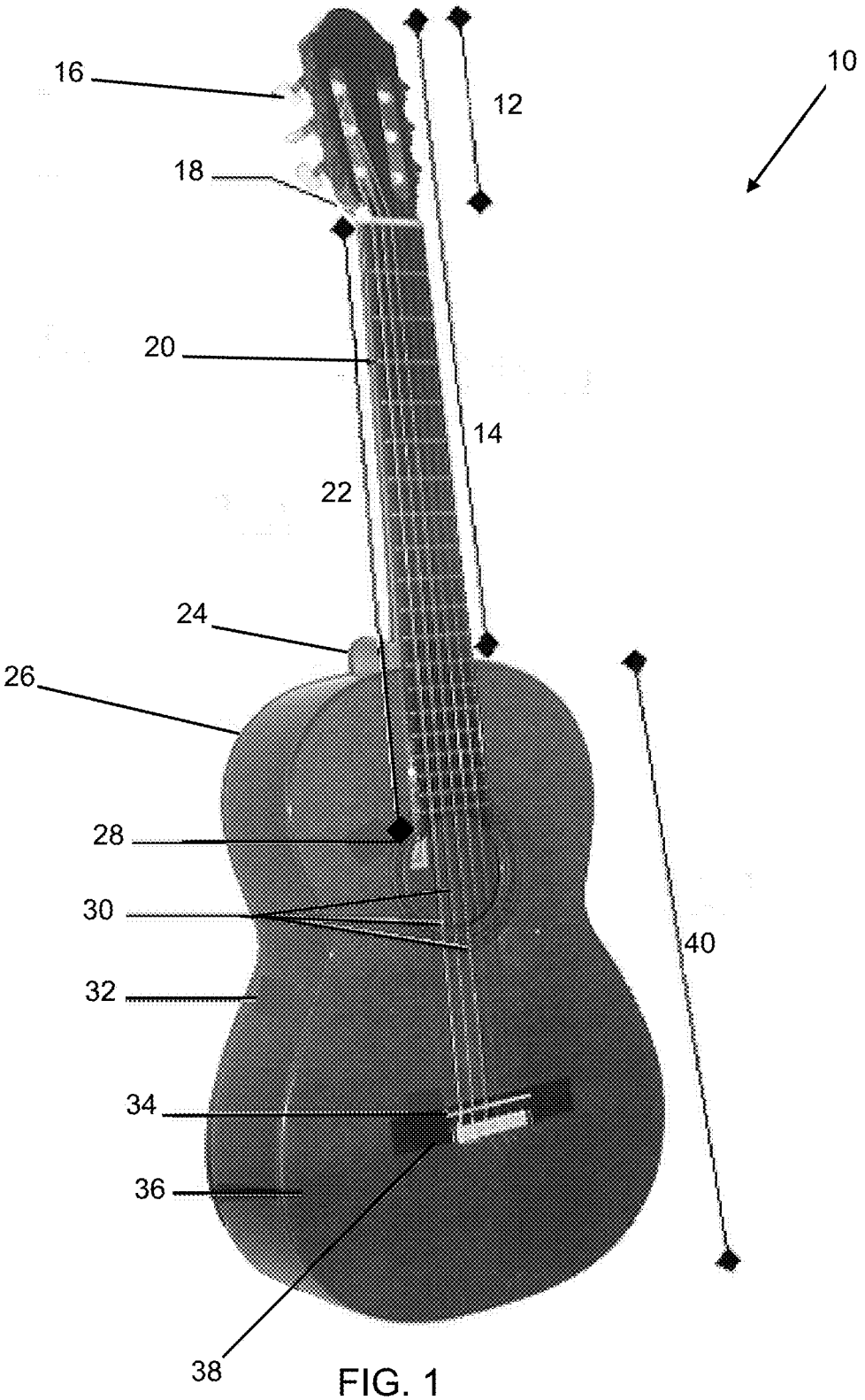
FIG. 1 (Prior Art)
FIG. 1 is a perspective view of a prior art acoustic guitar.
Figure 2:
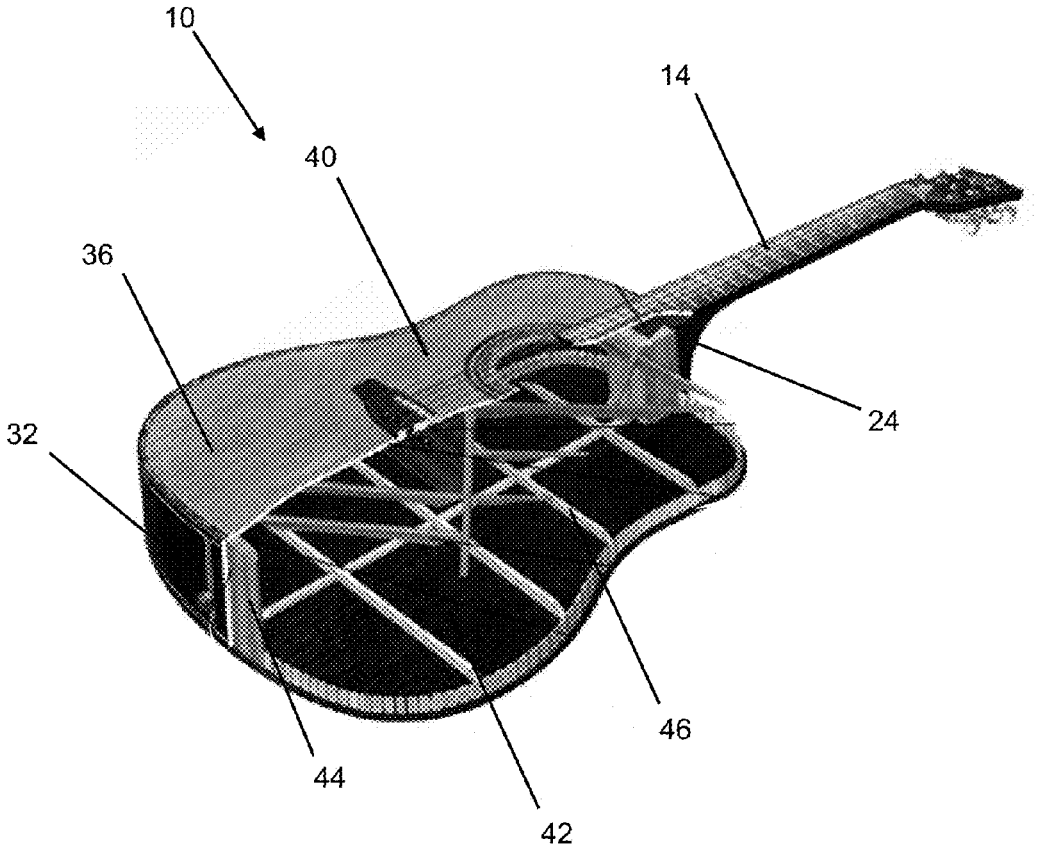
FIG. 2 (Prior Art)
FIG. 2 is a sectional perspective view of the prior art acoustic guitar of FIG. 1.
Figure 3A:
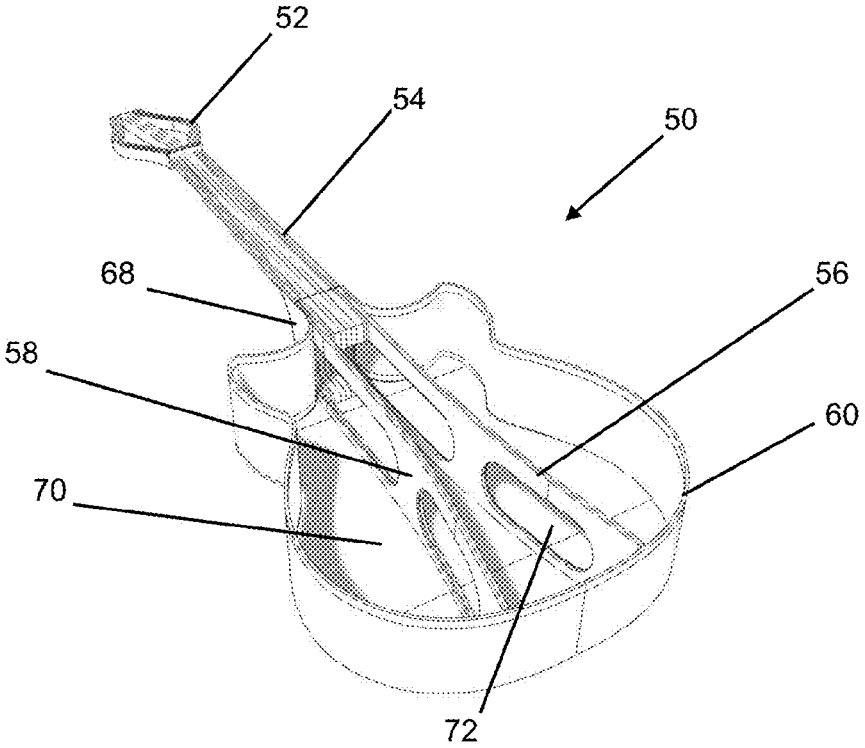
FIGS. 3A-3F are partial perspective views of an acoustic instrument with the top removed with a neck through body design according to an embodiment of the invention.
Figure 3B:
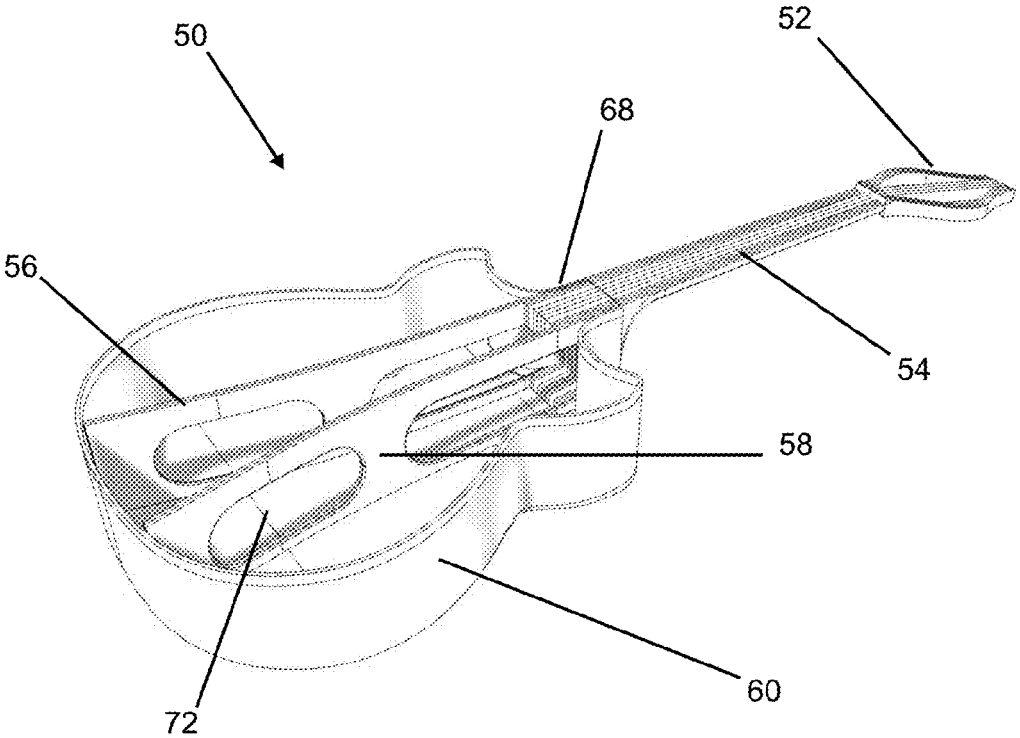
Figure 3C:
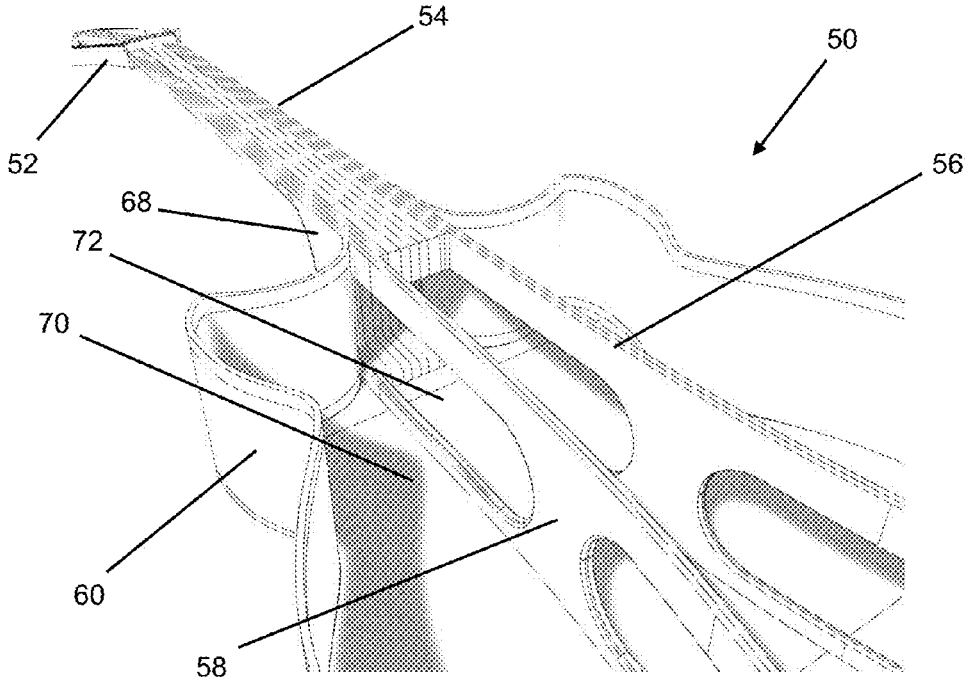
Figure 3D:
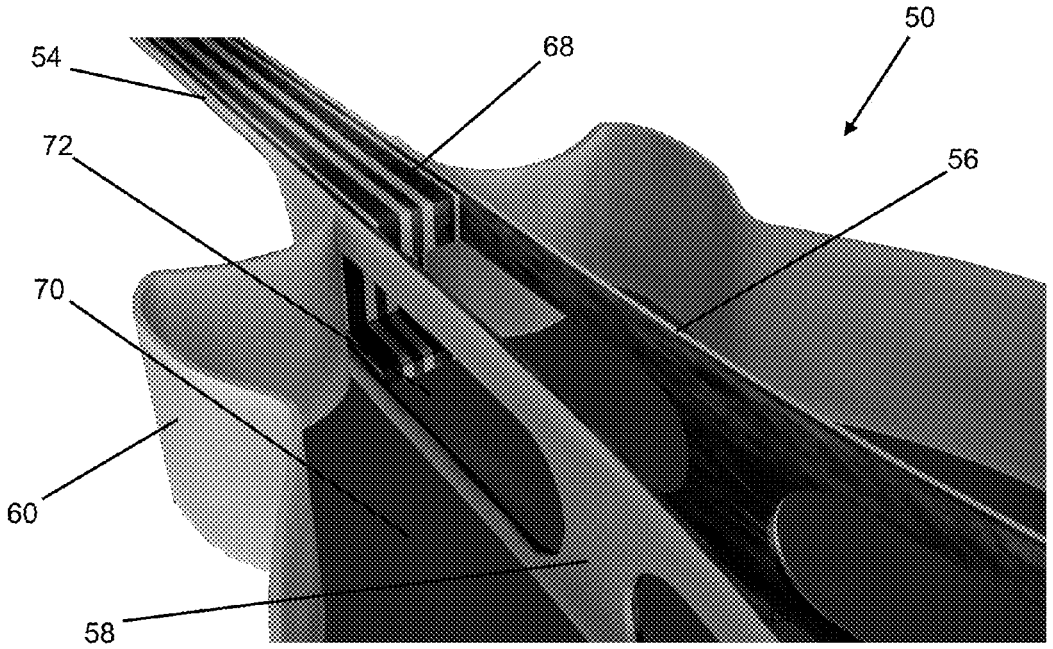
Figure 3E:
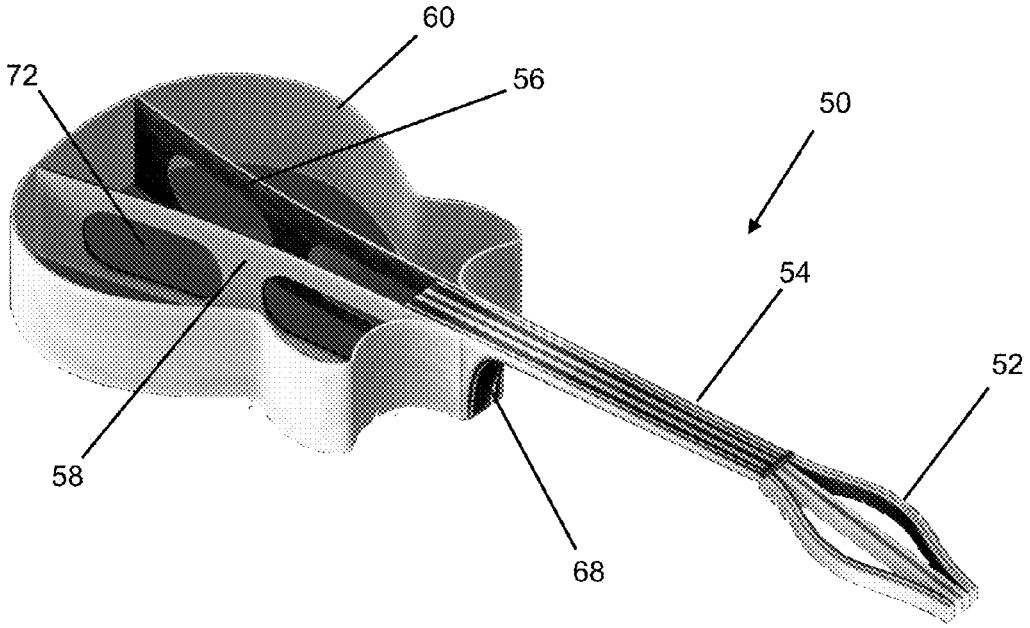
Figure 3F:
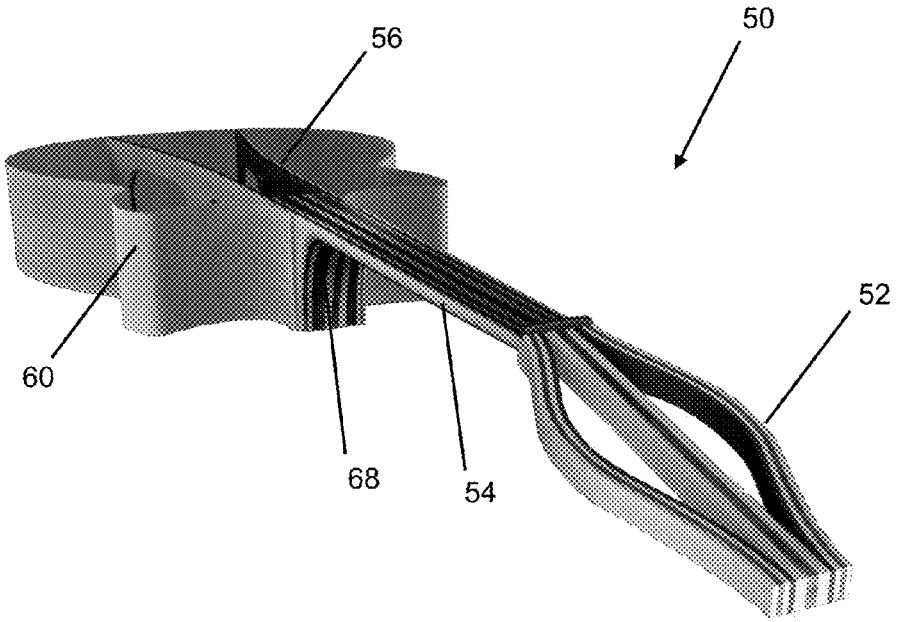

The present invention has utility as an acoustic instrument with a hollow body that incorporates a neck through body design with reduced bracing for increased sustainability of tone and volume for an enhanced total sound quality.

The innovative design of the neck through body adds unparalleled strength to the body's top and back, which give the acoustic instrument a "solid" structure design despite the hollow body. The solid feel obtained with the innovative design is similar to the feel of solid body guitars. When implemented in acoustic guitars, the novel neck through body eliminates the need for neck resets, and minimizes normal truss rod adjustment. The bracing found on existing guitars is removed because of the design of the innovative through neck design. Furthermore, the body construction, because of the reduced bracing, allows for a more responsive sounding guitar.

Referring now to the figures, FIGS. 3A-3F are perspective views of an embodiment of an inventive neck through body acoustic instrument 50 with the sound board or top removed from the body 60. In the embodiment shown in the figures, an acoustic guitar 50 is shown, however it is noted that other acoustic string instruments may be implemented with the neck through body design as disclosed herein.

In embodiments of the inventive neck through body acoustic instrument 50, the headstock 52 and neck 54 are formed by laminating strips of material together, such as but not limited to various varieties of wood. The outer side laminations extend beyond or past the heel 68, which in specific embodiments the heel 68 is integrated into the neck 54, and form a thru neck "A" brace 56. The thru neck "A" brace 56 has an integral bridge post 58 that extends between the sound board (top) 66 (see FIG. 4) internal surface to the bottom 70.

Figure 4:
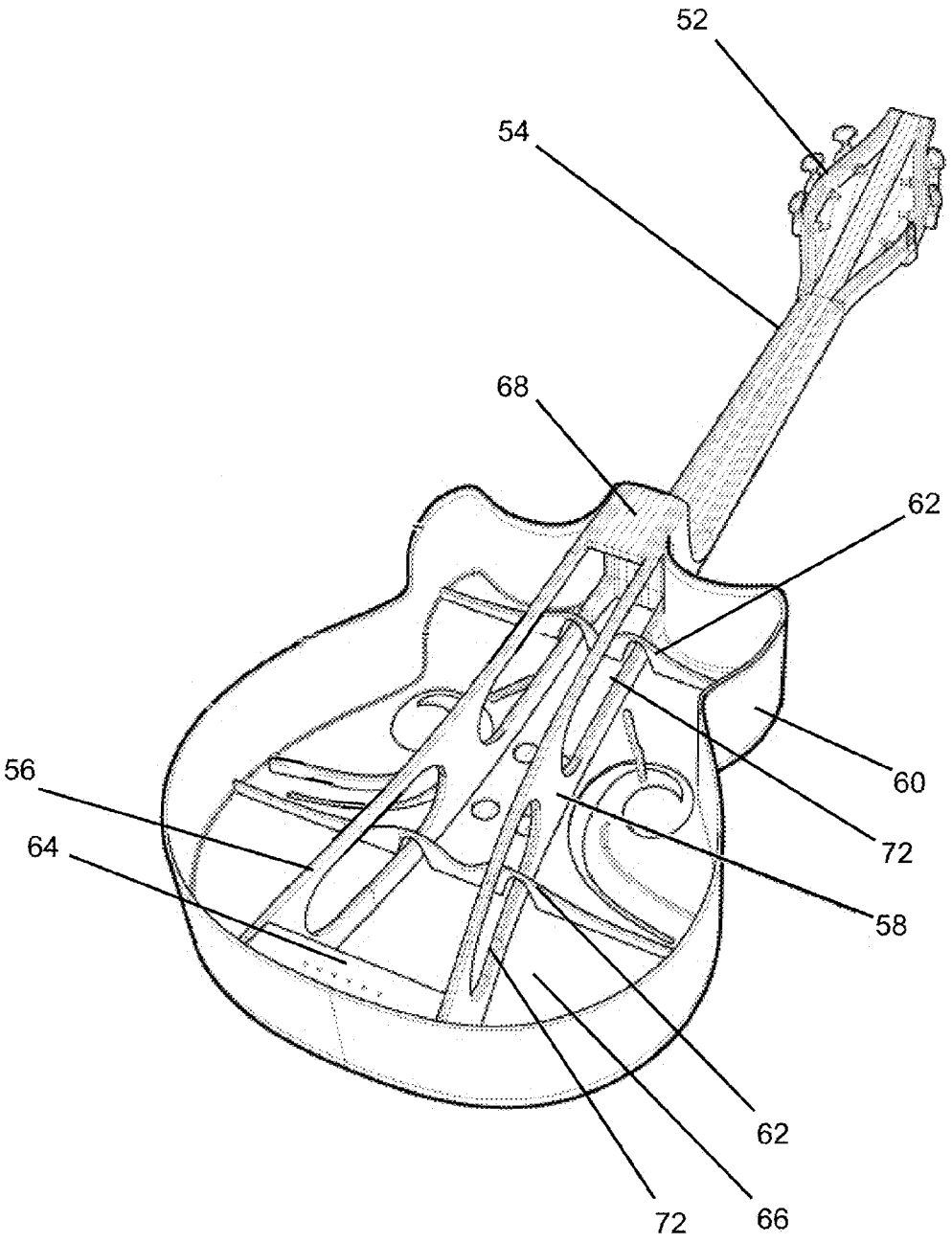
FIG. 4 is a top perspective view of the acoustic instrument of FIG. 3 with transverse bracing in the body, the transverse bracing not in contact with the "A" brace extending from the neck into the body.
Figure 5A:
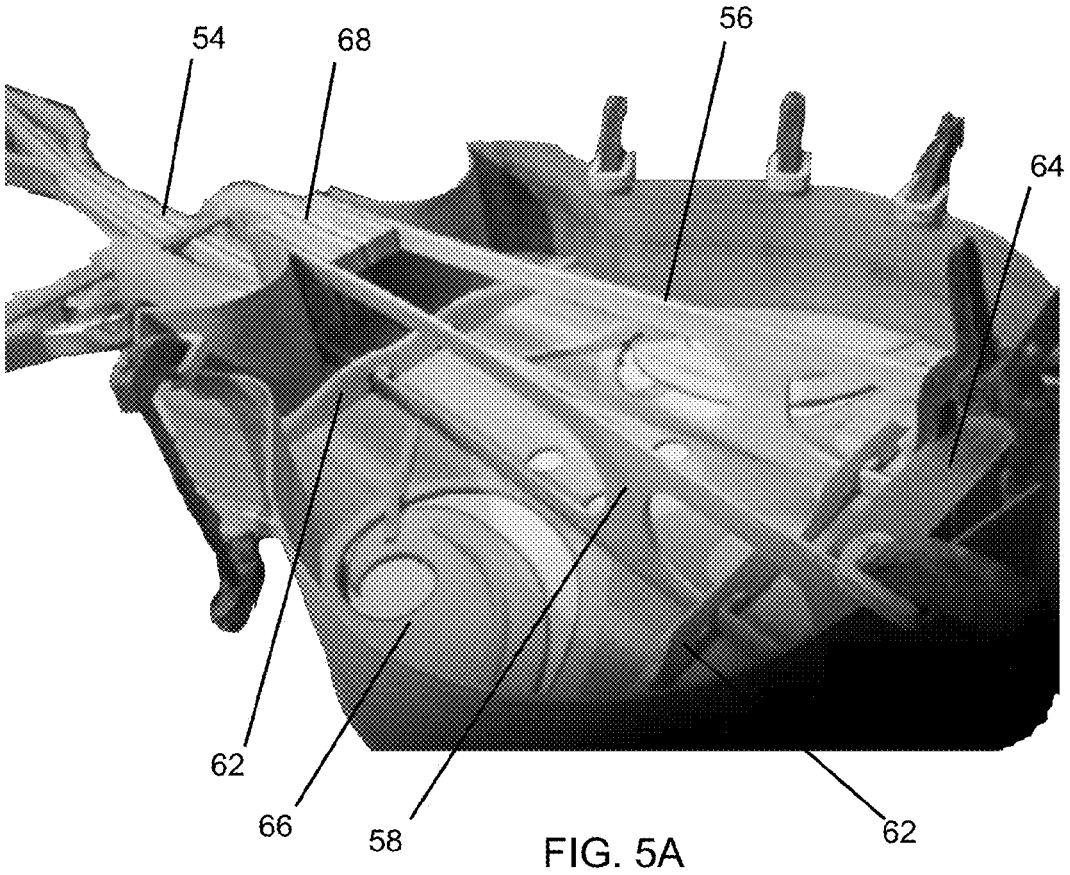
FIGS. 5A-5F are perspective views of the assembly of an acoustic instrument according to an embodiment of the invention.
Figure 5B:
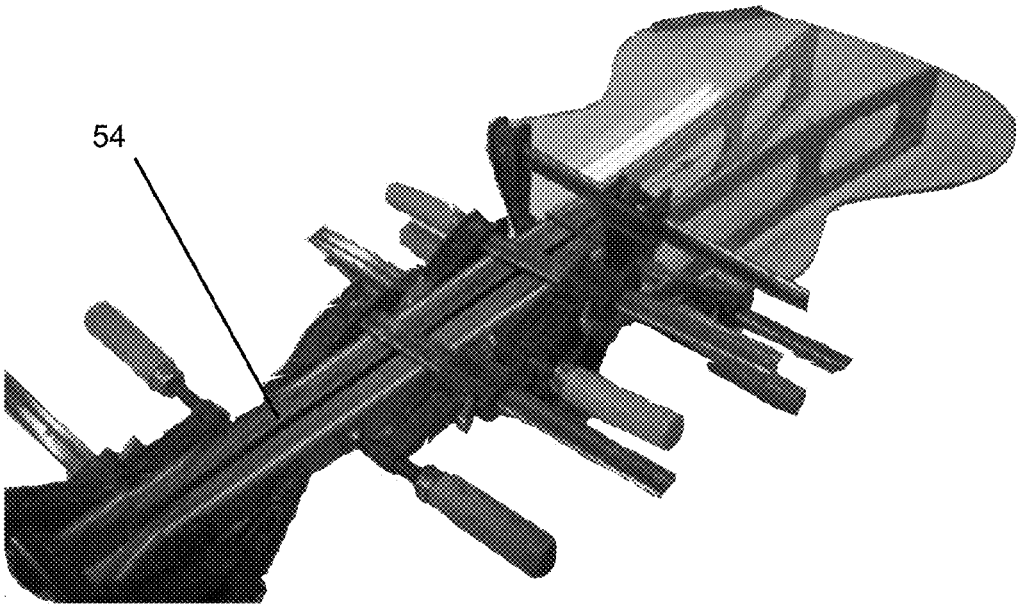
Figure 5C:
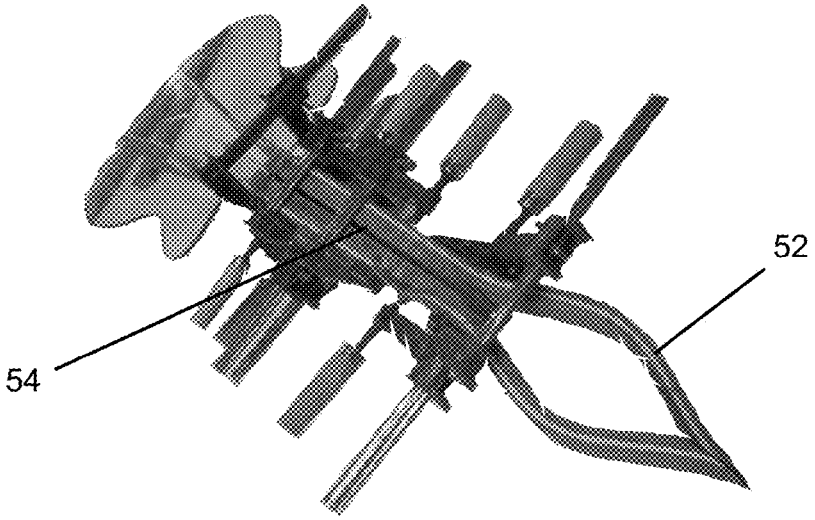
Figure 5D:
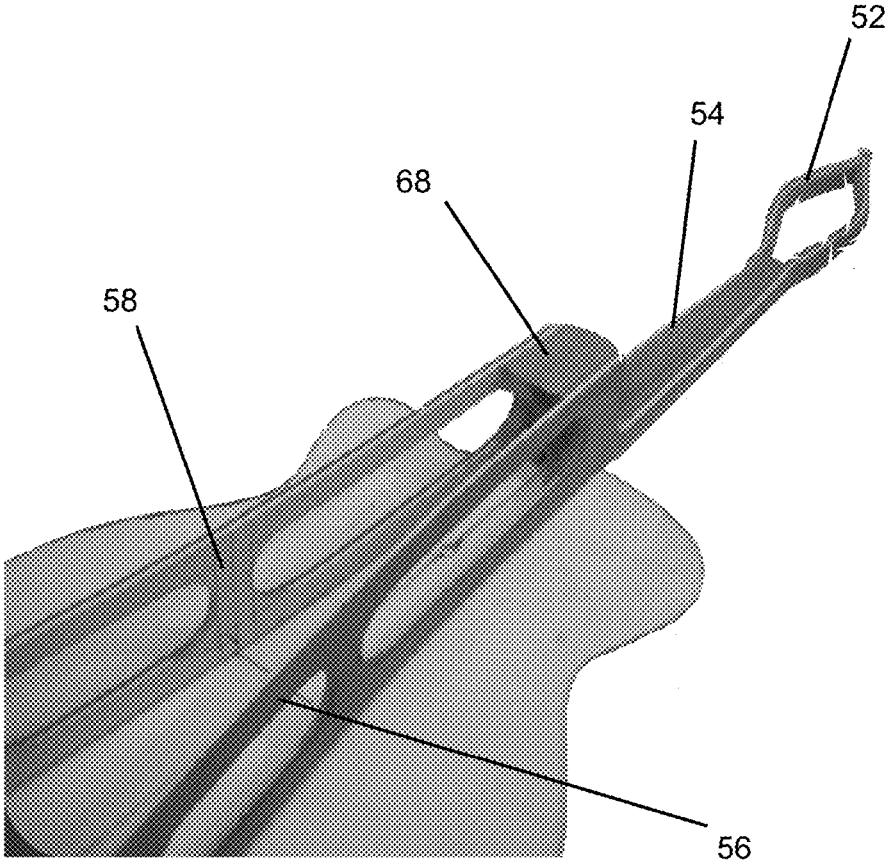
Figure 5E:
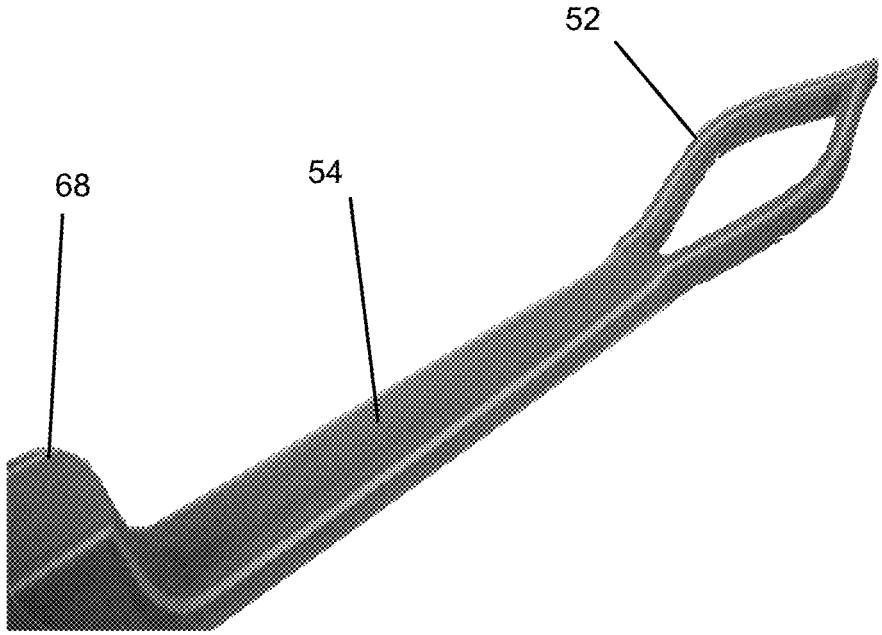
Figure 5F:
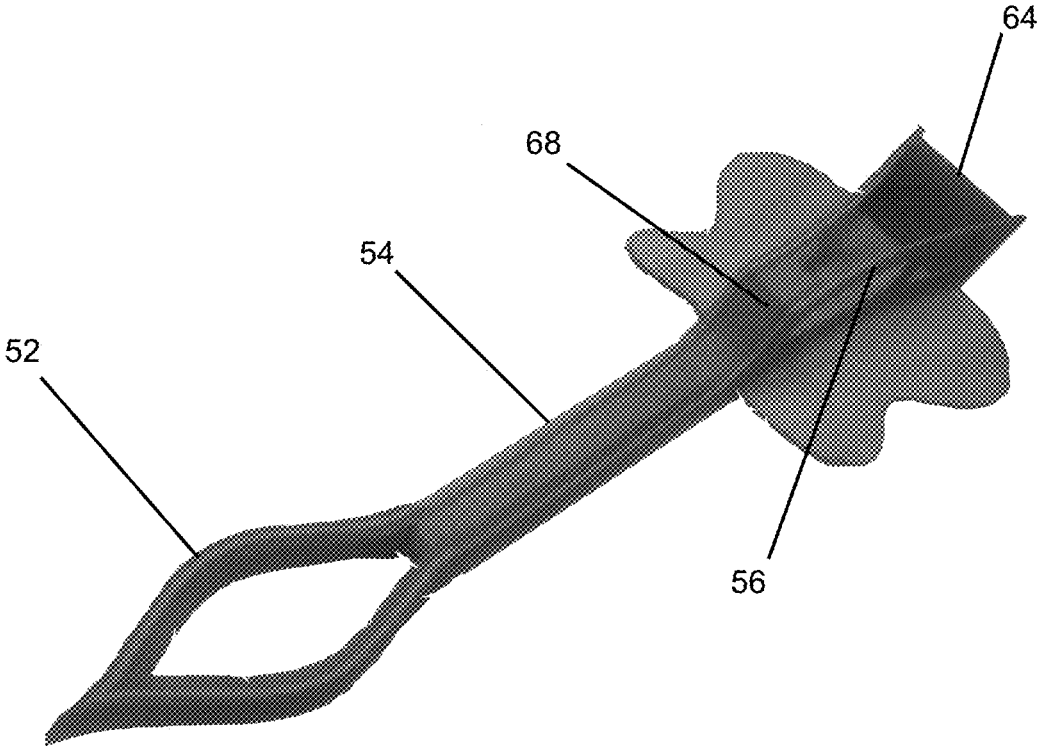

FIG. 4 is a perspective view of the inventive neck through body acoustic instrument 50 with the bottom 70 removed from the body 60 to reveal transverse bracing 62 that is approximately perpendicular to the "A" brace 56. The transverse bracing 62 is fixedly secured to the sound board 66 internal surface, while and the transverse bracing 62 crosses through the apertures 72 of the "A" brace 56 without touching the "A" brace 56. By not touching or bridging across the "A" brace 56, the sound board 66 is free to vibrate independently from the "A" brace 56 extending into the body 60 and attached at tail block 64.

FIGS. 5A-5F are perspective views of the assembly process of an acoustic instrument according to an embodiment of the invention. The parts of the inventive neck through body acoustic instrument 50 are joined together by lamination or gluing, as well as with various fasteners such as screws, and nuts and bolts. The instrument 50 is fixtured with clamps during the lamination and curing process.

Although the present invention has been described with reference to preferred embodiments, numerous modifications and variations can be made and still the result will come within the scope of the invention. No limitation with respect to the specific embodiments disclosed herein is intended or should be inferred.

The invention claimed is:

1. An acoustic string instrument comprising:

a headstock formed at a distal end of a neck, said headstock and said neck formed with a plurality of laminated material strips;

a heel formed at the proximal end of said neck, said heel fixedly attached to a hollow body, said hollow body comprising a bottom surface joined to a top surface by a sidewall defining an inner volume;

a pair of opposing outer strips from said plurality of laminated material strips, said pair of outer strips extending past said heel to form an "A" brace in said inner volume, where said "A" brace has a plurality of apertures and an integrated bridge post that extends between said bottom surface and an inner side of said top surface of said hollow body; and one or more transverse braces fixedly attached to said inner side of said top surface, where each of said one or more transverse braces crosses through the plurality of apertures of said "A" brace without touching said "A" brace.

2. The instrument of claim 1 wherein said laminated material strips are formed from a variety of wood.

3. The instrument of claim 1 wherein said "A" brace terminates at a tail block positioned between said "A" brace within said hollow body.

* * * * *